US005862649A

United States Patent [19]

Benz

[11] Patent Number: 5,862,649

[45] Date of Patent: Jan. 26, 1999

[54] METHOD AND DEVICE FOR PACKAGING CANS OR TUBES

[75] Inventor: Gottlieb Benz, Flums, Switzerland

[73] Assignee: Pamag AG, Flums, Switzerland

[21] Appl. No.: 949,579

[22] Filed: Oct. 14, 1997

[30] Foreign Application Priority Data

Oct. 17, 1996 [CH] Switzerland ..... 19962536/96

[51] Int. Cl.[6] ..... B65B 35/30

[52] U.S. Cl. ..... 53/447; 53/473; 53/168; 53/201; 53/540; 53/247; 53/249

[58] Field of Search ..... 53/48.1, 168, 201, 53/247, 249, 396, 398, 447, 473, 540

[56] References Cited

U.S. PATENT DOCUMENTS

| | | | |
|---|---|---|---|
| 5,704 | 1/1848 | Benz | 53/201 X |
| 3,054,236 | 9/1962 | Stroop | 53/201 X |
| 3,383,829 | 5/1968 | Duddleston et al. | 53/201 X |
| 3,465,494 | 9/1969 | Garrett et al. | 53/201 X |
| 4,534,153 | 8/1985 | Nowicki | 53/448 |
| 4,554,777 | 11/1985 | Denk et al. | 53/201 |
| 4,565,048 | 1/1986 | Lade | 53/201 |
| 5,060,454 | 10/1991 | Benz | 53/444 |
| 5,339,606 | 8/1994 | Benz | 53/444 |
| 5,570,567 | 11/1996 | Laubscher et al. | 53/540 X |
| 5,636,498 | 6/1997 | Belanger et al. | 53/444 |
| 5,651,236 | 7/1997 | O'Neill | 53/447 |

*Primary Examiner*—Daniel B. Moon

*Attorney, Agent, or Firm*—Speckman Pauley Petersen & Fejer

[57] ABSTRACT

A method and apparatus for packaging cans or tubes which arrive from a conveying station and which are placed into a packaging fixture. The cans are moved in the packaging fixture to a packaging station and are together removed from the packaging fixture in the form of a dense package and are provided with common packaging. The cans are then passed on to the next following processing station. Using interchangeable packaging modules, the cans or tubes are selectively filled into a box or are provided with a hoop. In the process, the packaging material is brought to the packaging station in a delivery plane which extends vertically with respect to a direction of delivery of the cans or tubes from out of the packaging fixture. The box to be filled is delivered by a box carrier which is movable in the delivery plane, to the packaging station, and is there taken over by a suction gripper.

11 Claims, 6 Drawing Sheets

METHOD AND DEVICE FOR PACKAGING CANS OR TUBES

BACKGROUND OF THE INVENTION

1. Field of the Invention

This invention relates to a method and apparatus for packaging cans or tubes, wherein cans or tubes arriving from a conveying station are placed into a packaging fixture, are moved in the packaging fixture to a packaging station and are together removed from the packaging fixture in the form of a dense package with a common packaging, after which they pass on to the next following processing station.

2. Description of Prior Art

Installations for producing tubes or cans are extremely expensive and for their amortization must be operated as much as possible at full capacity and without expensive outage and refitting times. A key spot in the course of production up to the product which is ready for shipment is the packaging of the individual cans or tubes. The two customary types of packaging for such empty containers are packaging in boxes and encasing in hoops. Both methods have different advantages and disadvantages. Encasing in hoops is economical because of the low price and the low volume and weight, and is of great ecological interest. Since the thin encasing hoops are continuously fed from delivery rolls and are cut to the correct size at the place of hooping, hooping units can be integrated in the packaging machines in a space-efficient manner. On the other hand, packaging in boxes protects the cans and tubes against damage and soiling, which can be important, for example in the pharmaceutical and foodstuff area.

Up to now only packaging machines were available which could be used either for encasing the cans or tubes in hoops or for packaging the cans or tubes in boxes. Changing from the one type of packaging to the other requires not only two conventional machines, but also results in a considerable logistic effort for refitting the packaging installation in the packaging area, or for transporting the cans or tubes to the respective packaging unit.

In conventional installations for packaging cans and tubes in boxes, delivery of the empty boxes results in great spatial and mechanical demands on the packaging device, since the boxes are often transported horizontally and must be tilted into a vertical position for filling, or the boxes are loaded step-by-step and must be movable in order to be positioned exactly in different positions. In this case the delivery of the boxes generally takes place by means of conveyor belts.

SUMMARY OF THE INVENTION

It is one object of this invention to provide a method and an apparatus, which permit a simple change of the type of packaging for a same machine.

This object can be achieved with a method and a device as discussed throughout this specification and in the claims.

The method in accordance with one preferred embodiment of this invention uses a packaging machine with an interchangeable packaging module which can be used for encasing cans or tubes in hoops and, in a further embodiment, for packaging the cans or tubes in boxes. By merely exchanging the packaging modules, it is possible to convert from the packaging type of encasing in hoops to the packaging type of placing into boxes, and vice versa, without it being necessary to perform extensive and therefore time-intensive refitting of the machine, or even to exchange the entire packaging machine. This is possible because the box delivery takes place laterally, in other words, vertically with respect to a filling direction of the cans or tubes into the box. The packaging fixture and suction gripper elements can be used for encasing in hoops as well as for boxing. The packaging module can furthermore be embodied to be very narrow, since the minimal width is limited by the depth of the box to be filled.

When changing the type of packaging, a brief interruption of the packaging machine is sufficient, during which the packaging module is exchanged. Depending on the embodiment, small adaptations of the packaging fixture and the suction gripper are additionally made and the control program is changed.

Since all components of the packaging machine, with the exception of the changing modules, are used for both types of packaging, a packaging machine can be expanded by a packaging function for the price of the changing module which is small in comparison to the purchase costs of such a machine.

The construction of the box-filling module makes it possible, using the modular construction, for all cans or tubes necessary for filling a box to be filled into the box in one step and in a desired dense package.

A further advantage of this invention is that the packaging modules can be employed with different machines and can be exchanged between machines.

One preferred embodiment of this invention is shown in the attached drawings, and the method in accordance with this invention will be explained in view of the drawings.

DESCRIPTION OF PREFERRED EMBODIMENTS

In the specification and in the claims, the term cans is intended to include cans, tubes and similar containers. Furthermore, a lowered position of a packaging fixture will be an assumed spatial reference, however, the packaging fixture need not necessarily be lowered at each described time.

Figure 1:
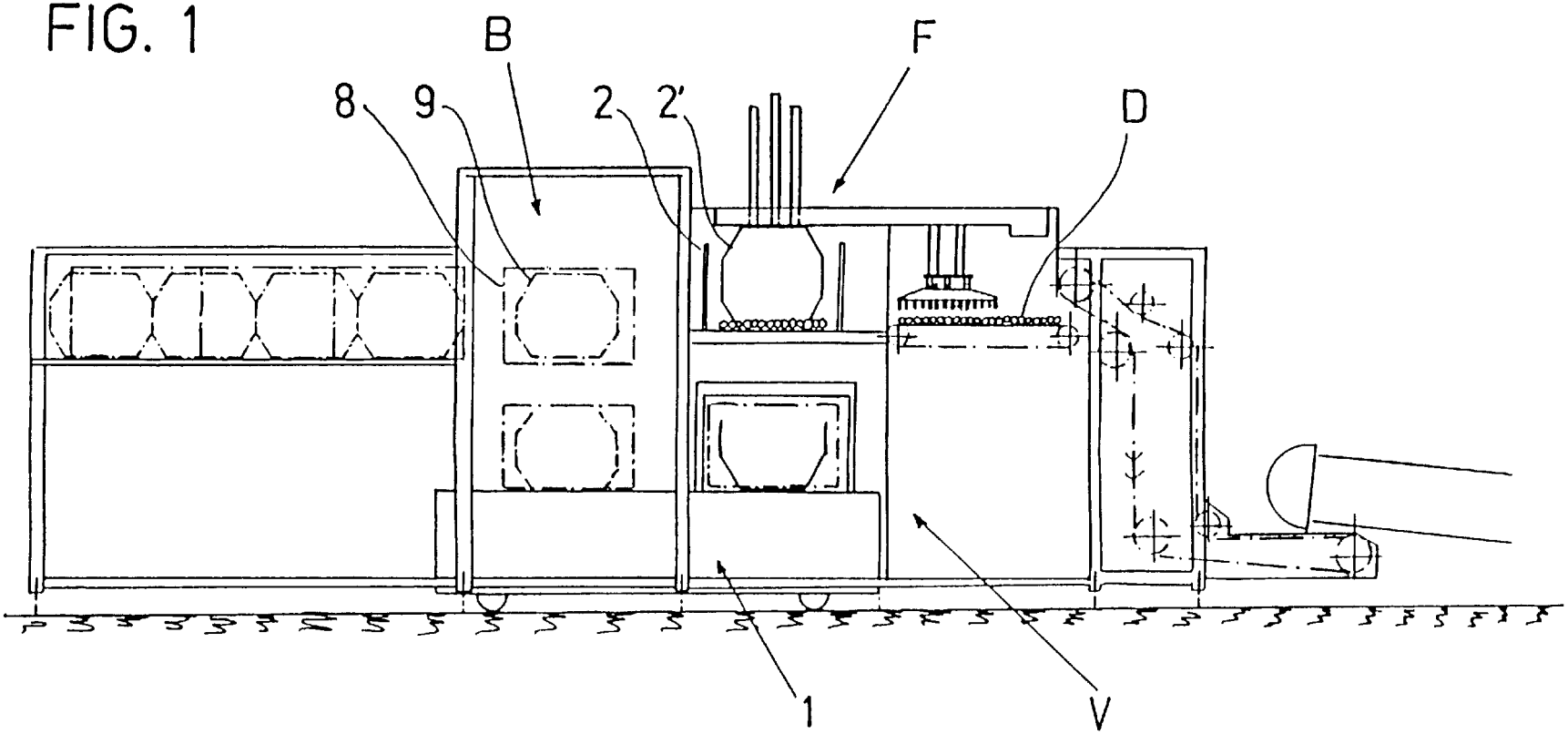
FIG. 1 shows a schematic side view of a packaging machine, according to one preferred embodiment of this invention.
Figure 2A:
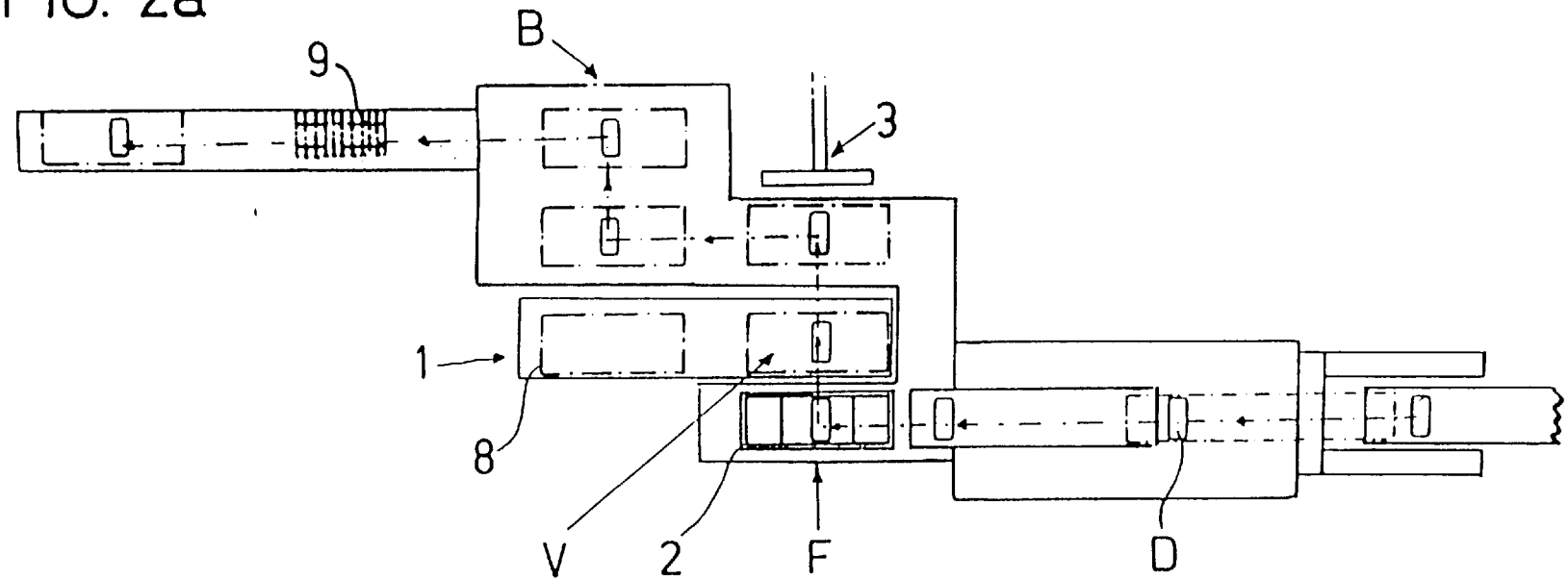
FIG. 2*a* shows a schematic top view of a packaging machine with a conveying path of cans.
Figure 2B:
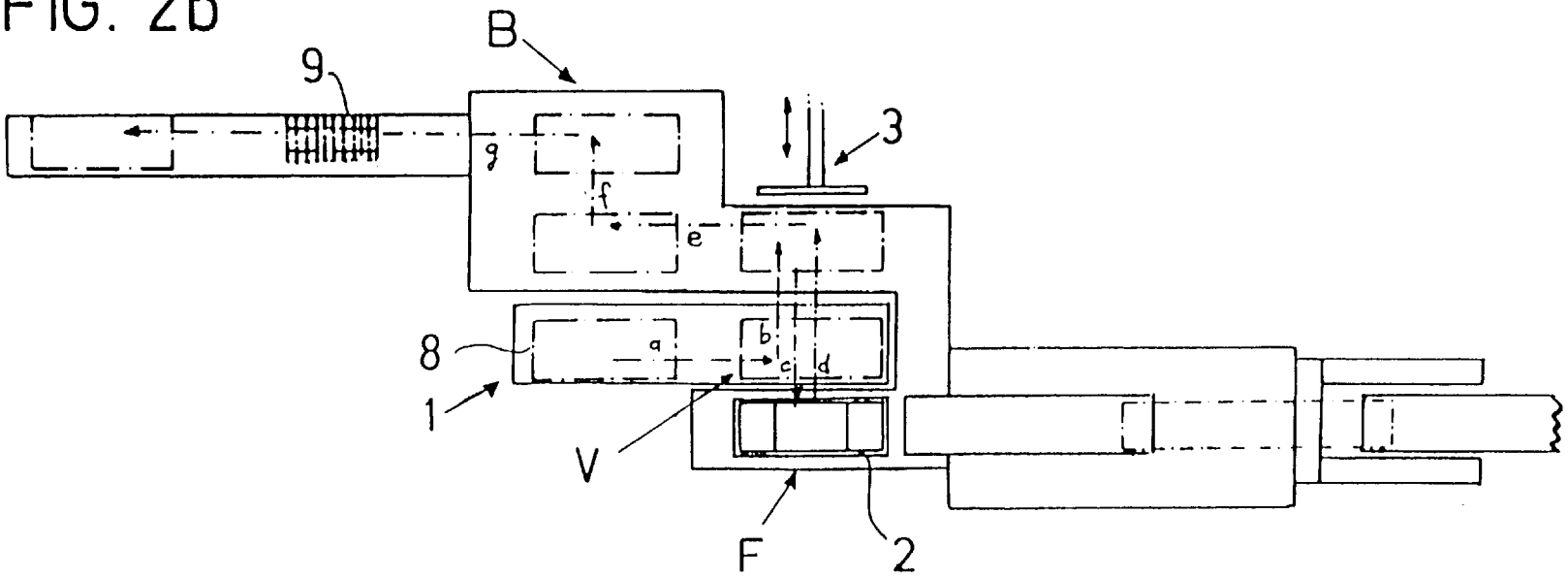
FIG. 2*b* shows a schematic top view of a packaging machine, as shown in FIG. 2*a* but with a conveying path of a box.

The schematic structure of the packaging machine in accordance with this invention is shown in FIGS. 1, 2*a* and 2*b*. In a conveying station F, respectively one layer of cans D is pushed by means of a pusher, not shown in the drawings, into a packaging fixture 2, which can be lowered in steps. The shape of the packaging fixture 2 in this case corresponds to the shape of the packaging to be provided. If the cans D are to be encased in a hoop, the packaging fixture preferably has a hexagonal shape, as shown in FIG. 1 by the reference numeral 2'. If the cans D are packed in boxes, the packaging fixture 2 corresponds to the opening of the box and is preferably rectangular, as shown in FIG. 2*a*.

The packaging fixture 2 is moved from the conveying station F to the packaging station V. In this example it is lowered for this purpose. In the packaging station V the cans D are together removed from the packaging fixture 2 in a dense pack in order to provide them with a mutual packaging. Further conveyance takes place by means of a suction gripper 3, which has a flat suction surface oriented parallel with respect to the packaging fixture. The suction gripper 3 can be moved in the direction toward the can release from the packaging fixture 2, the filling direction, and has a front end position at the place of packaging and a rear end position in which the packaged cans D reach a transport plate. The transport plate can be displaced vertically with respect to the filling direction, where the cans D are held in place by a pressure arm pushing on the can D from above, and are passed on with this transport plate to a next following processing station B. In this case the processing station is a control station, in which the packaged cans D are lifted to eye level on a conveyor belt and are slightly inclined, so that the can bottoms become visible for a cleanliness check. The conveying path of the cans D is represented by arrows in FIG. 2*a,* wherein a single can D is symbolically represented. The path of the packaging material in case of packaging in boxes is visible in FIG. 2*b,* wherein the movements a–g are performed; in case of encasing in hoops, the movements b and c are omitted.

The type of packaging can be selected between filling in boxes and encasing in hoops. Of packaging modules 1, 1', which are seated on rollers, respectively one packaging module 1, 1' can be pushed into a bay of the packaging machine provided for this purpose, more exactly between the lowered packaging fixture 2 and the suction gripper 3, and can be exactly positioned and arrested by means of adjusting screws or rails. Each packaging module comprises a base body, on which either a box or a hoop feed is arranged. The packaging material, i.e. the box or the hoop, in this case is brought to the packaging station in a plane, the delivery plane, which is located vertically with respect to the direction of the removal of the cans D from the packaging fixture, the filling direction. The packaging fixture 2 and the suction gripper 3 are required for both types of packaging. They can therefore be identical or, depending on the shape of the desired packaging, they can also be exchanged in the course of the change of the packaging module.

However, it is essential that the same holders and displacement mechanisms are used for all types of packaging fixtures 2 or suction grippers 3.

Depending on whether encasing in a hoop or filling a box is performed, the packaging module is an encasing module or a box- filling module.

The encasing module comprises elements known to those skilled in the art and is therefore not discussed in detail. A roll of hoops and means for encasing in a hoop are present on the encasing module. The other elements described are part of the stationary packaging machine. The lowered packaging fixture 2 filled with the cans D is guided in the horizontal direction on the encasing module and the hoop is looped around the cans D, is cut and the ends are welded. A suction gripper 3 with several suction openings is guided to the cans D on the side facing away from the packaging fixture 2 and grips the cans D by means of a vacuum. In this case the cans D are aligned in such a way that the can bottoms are facing toward the suction gripper 3. At the same time or thereafter the now empty packaging fixture is horizontally retracted and again lifted to the conveying station F. The suction gripper 3 is retracted in the loading direction from the place of packaging and in the process takes the hooped cans along. In the rear end position, the hooped can package 9 reaches the transport plate, which can be displaced vertically with respect to the loading direction, is held in place by a pressure arm pushing from above on the hooped package and is passed on with this transport plate to the processing station.

Figure 3:
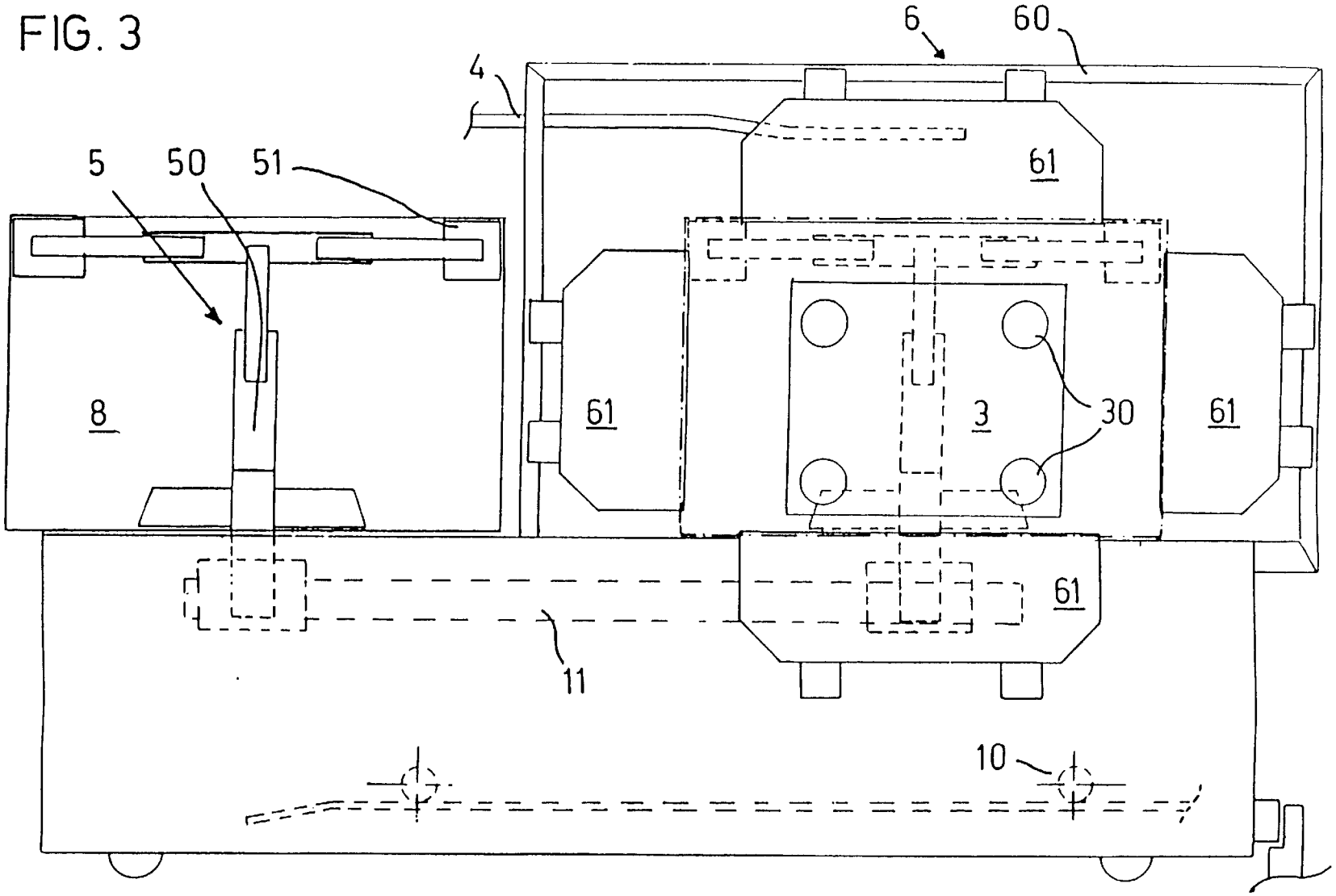
FIG. 3 shows a side view of a packaging station, according to one preferred embodiment of this invention.
Figure 4A:
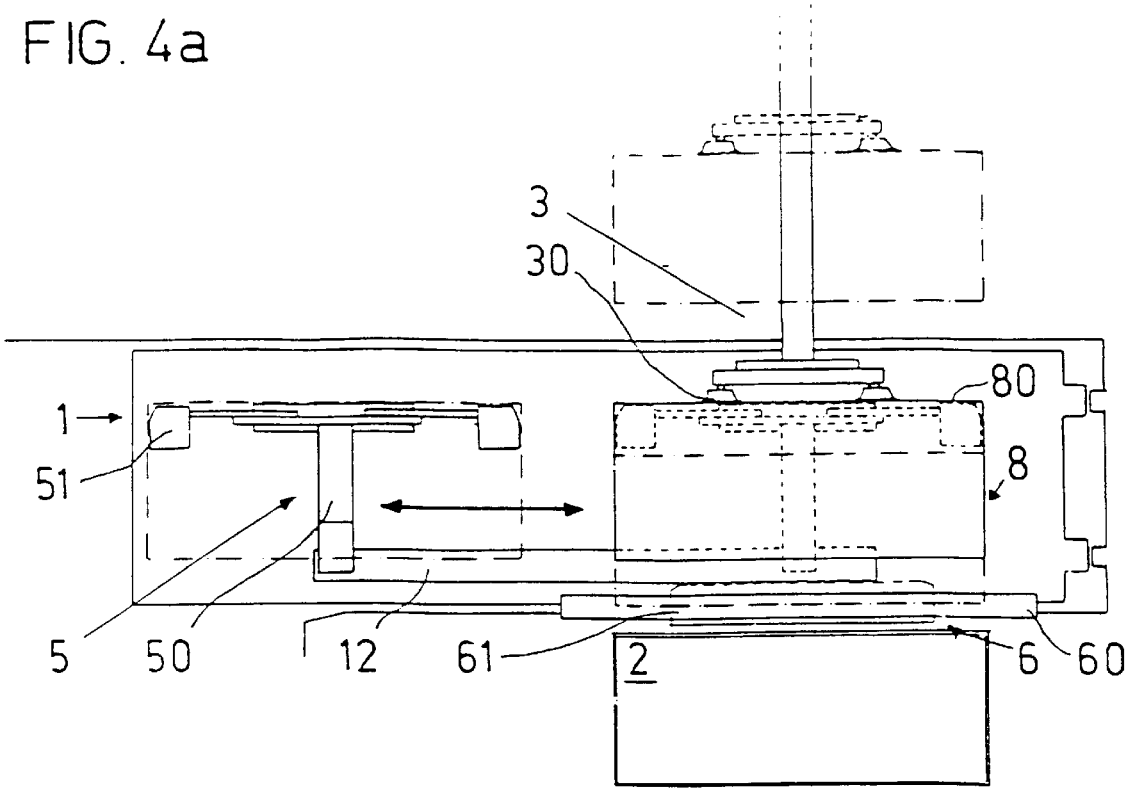
FIG. 4*a* shows a top view of the packaging station shown in FIG. 3, with a path of the box carrier.
Figure 4B:
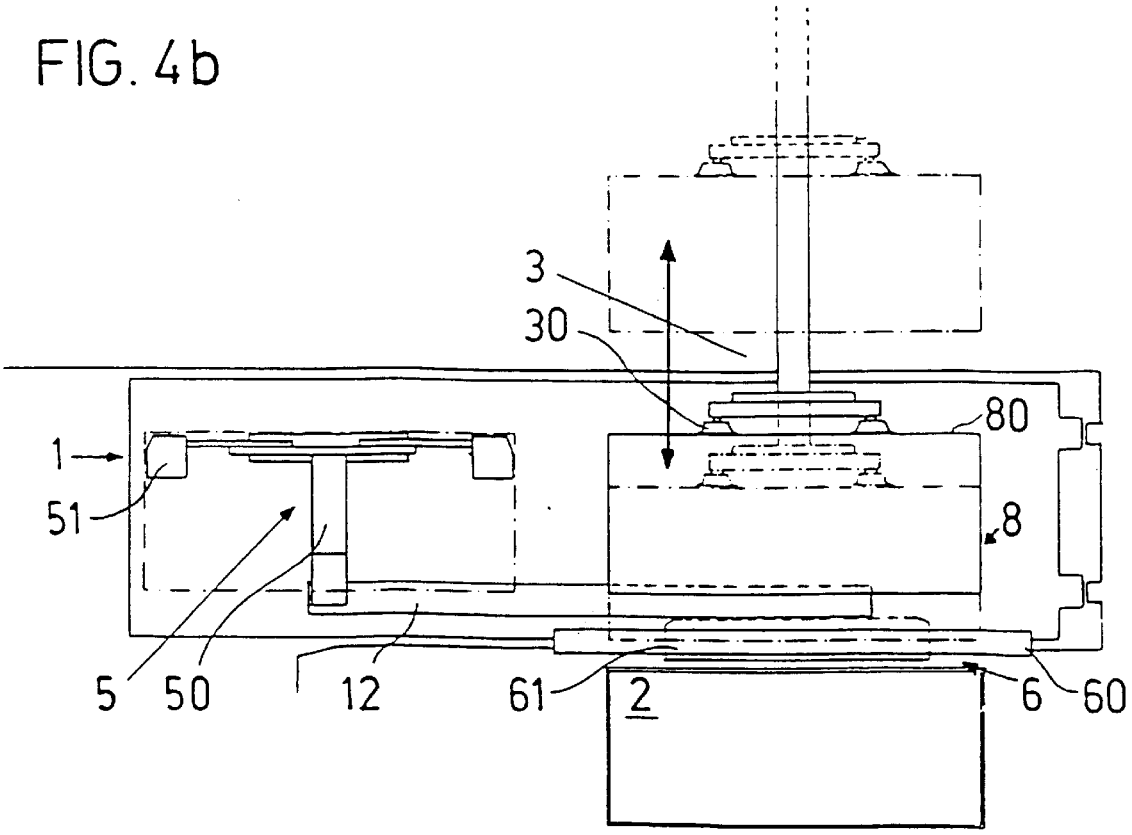
FIG. 4*b* shows a top view of the packaging station shown in FIG. 4*a,* with a path of the suction gripper.

The box-filling module 1 is represented in FIGS. 3, 4*a* and 4*b*. The box-filling module 1 has a vertically extending box carrier 5, which can be moved in a delivery plane from an outer end position to an inner end position, which adjoins the packaging fixture. In this embodiment the box carrier 5 comprises a carriage, which can be moved back and forth in the horizontal direction along a slit 12 in the box-filling module 1 by means of a linear cylinder 11. In another embodiment the box carrier 5 is a pivot arm, which is pivotable in the delivery plane.

The box carrier 5 has a support arm 50 and at least one, preferably but not necessarily three, attached displaceable extension arms 51. In the outer end position, an open box 8 which is to be filled is upended in a lateral position on the box carrier 5. The latter can be adapted to the size of the box 8, because of the displaceable extension arm 51. The support arm 50 and the extension arm 51 are designed in such a way that, with the box placed thereon, the box bottom is on the side facing away from the packaging fixture. The opening of the box 8 is therefore at the side. If the box carrier 5 moves horizontally, the box 8 is upended on the box carrier in correspondence to the orientation of the packaging fixture. In the case of the pivotable box carrier 5, the box 8 is rotated by 90°.

The box carrier 5 now moves with the box 8 to the packaging station between the lowered packaging fixture 2 and the suction gripper 3 up to an inner end position, which is indicated by dashed lines in FIG. 4*a*. Here, the box 8 is taken over by the suction gripper 3, wherein the suction gripper 3 is simultaneously or subsequently pushed horizontally in the direction toward the lowered packaging fixture 2 until it touches the bottom 80 of the box 8. The suction gripper 3 is fixed by suction on the box bottom 80 and moves away from the box carrier 5 with the box 8. In a preferred embodiment, the suction gripper 3 has a square suction plate with at least four suction cups 30, which are arranged in the comers of the suction plate.

The box carrier 5 is now moved away at least far enough so that it completely frees the opening of the box 8. Preferably it is returned into its outer end position to take up a fresh box 8. But the suction gripper 3 moves with the box 8 to the lowered packaging fixture 2, as represented by dashed lines in FIG. 4*b*.

If the box 8 is a cardboard box, the box 8 is preferably picked up by a box holder 6. The box holder 6 is arranged stationary on the box-filling module 1 and comprises a box holder frame 60 and several, in this case 4, displaceable clamping elements 61. The box holder 6 is used for fixing the lateral walls of the box in place while being filled. To this end, the clamping elements 61 each have an inclined plate, which projects into the box opening and by displacement slightly presses the lateral walls outward. The cans D are now pushed from the packaging fixture 2 into the box 8 by means of a pusher, not shown in the drawings, wherein the inclined plates are used as guides.

Figure 5:
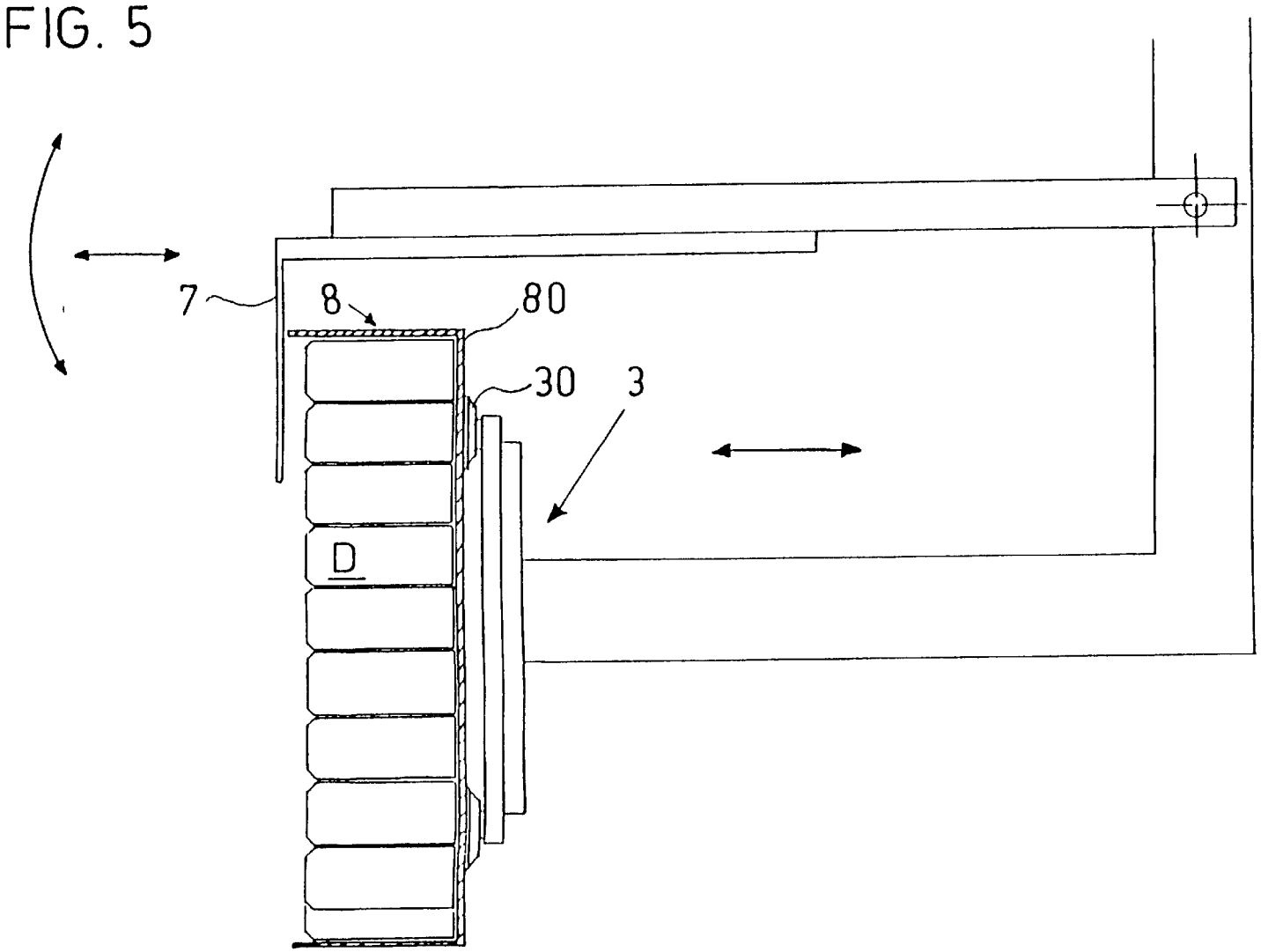
FIG. 5 shows a detailed view of the packaging station with a protective plate.

In a preferred embodiment a protective plate 7, which is coupled with the movement mechanism of the suction gripper 3, is now at least partially pivoted over the opening of the now filled box and is preferably pressed against it so that the cans D are held in place in the box 8. These movement directions are represented by arrows in FIG. 5. It has been shown to be sufficient if the protective plate 7 covers the topmost or several of the upper layers of the cans D.

The suction gripper 3 pulls the filled box 8 back from the packaging station in a horizontal direction vertically extending with respect to the delivery direction, as far as the rear end position. In this way the box 8 always reaches the transport plate, which is displaceable vertically with respect to the loading direction, where it is released by the suction gripper 3 by means of deactivation of the vacuum, is held in place by a pressure arm pushing on it from above and is passed on with the transport plate to the processing station.

What is claimed is:

1. In a method for packaging cans (D) wherein the cans (D) arriving from a conveying station (F) are placed into a packaging fixture (2, 2'), are moved within the packaging fixture (2, 2') to a packaging station (V) and are together removed from the packaging fixture (2, 2') in a form of a dense package and are provided with a common packaging material, and then are passed on to a processing station (B), the improvement comprising:

using interchangeable packaging modules (1, 1') to one of selectively fill the cans (D) into a box (8) or provide the cans (D) with a hoop;

wherein the packaging material is delivered to the packaging station (V) within a delivery plane which extends vertically with respect to a direction of delivery of the cans (D) from out of the packaging fixture (2, 2'), and wherein the box (8) is delivered by a box carrier (5) which is movable in the delivery plane to the packaging station (V), and is taken over by a suction gripper (3).

2. The method in accordance with claim 1, wherein the box (8) is upended on the box carrier (5), after the suction gripper (3) lifts the box (8) off the box carrier (5) the box carrier (5) is removed from an area of the packaging station (V), and the suction gripper (3) delivers the box (8) to the packaging fixture (2), the cans (D) are pushed out of the packaging fixture (2) into the box (8), and the suction gripper (3) moves the box (8) from the packaging station (V) to the next processing station (B).

3. The method in accordance with claim 1, wherein the box carrier (5) comprises a carriage which is movable in a horizontal direction, the box (8) is upended on the box carrier (5) relative to an orientation of the packaging fixture (2), and an opening of the box (8) is located on a side of the box (8) facing toward the packaging fixture (2).

4. The method in accordance with claim 3, wherein the suction gripper (3) moves the box (8) in a direction parallel to the direction of delivery of the cans (D) into the box (8), and the suction gripper (3) grips a back of a bottom (80) of the box (8) by suction.

5. The method in accordance with claim 1, wherein while the box (8) is filled with the cans (D), at least a part of lateral walls of the box (8) are fixed in a position by a box holder (6).

6. The method in accordance with claim 1, wherein a movable pressure arm (4) is pressed on the box (8), a vacuum in the suction gripper (3) is deactivated, and a pressure arm (4) passes the box (8) on to the next following processing station (B).

7. In a packaging machine having a packaging fixture (2, 2') for dense packing of a plurality of cans (D), having packaging modules (1, 1') for enclosing the cans (D) in a hoop or packaging the cans (D) in a box (8), and having a movable suction gripper (3) for passing the packaged cans (D) to a processing station (B), the improvement comprising:

at least two of the packaging modules (1, 1') interchangeable with each other, wherein respectively one of the packaging modules (1, 1') can be inserted into the packaging machine between the packaging fixture (2, 2') and the suction gripper (3), at least one of the packaging modules (1, 1') being a hoop-encasing module (1') and at least one other of the packaging modules (1, 1') being a box-filling module (1), the box-filling module (1) having a box carrier (5) which is movable within a delivery plane which extends vertically with respect to a direction of delivery of the cans (D) from the packaging fixture (2).

8. The packaging machine in accordance with claim 7, wherein the packaging modules (1) have a stationary box holder (6) with a box holder frame (60) and a plurality of displaceable clamping elements (61) attached to the box holder frame (60) fixing a plurality of lateral walls of the box (8) while the box (8) is filled.

9. The packaging machine in accordance with claim 7, wherein the box carrier (5) is adapted to a size of the box (8).

10. The packaging machine in accordance with claim 7, wherein the suction gripper (3) has a flat suction surface oriented parallel with the delivery plane, and the suction gripper (3) is movable vertically with respect to the delivery plane.

11. The packaging machine in accordance with claim 10, further comprising a movable protective plate (7) for holding the cans (D) in the box (8), and the movable protective plate (7) pivoting in front of an opening of the box (8).

* * * * *